United States Patent [19]

Røisaeth

[11] 4,361,918

[45] Dec. 7, 1982

[54] DEVICES AND METHOD FOR HANDLING A PERSON ON A BASE

[76] Inventor: Kjell Røisaeth, Fossekollen, 5250 Lonevåg, Norway

[21] Appl. No.: 51,180

[22] Filed: Jun. 22, 1979

[30] Foreign Application Priority Data

Jun. 22, 1978 [NO] Norway ..... 782170

[51] Int. Cl.[3] ..... A61G 7/08; A61G 7/06; A61G 7/10

[52] U.S. Cl. ..... 5/81 R; 5/61; 280/47.21; 414/449

[58] Field of Search ..... 5/61, 62, 81 R, 81 B, 5/81 C, 82 R; 414/444, 448, 449, 486, 490, 81 R; 280/47.21; 410/51

[56] References Cited

U.S. PATENT DOCUMENTS

| | | | |
|---|---|---|---|
| 2,113,780 | 3/1938 | Yeats | 414/449 |
| 2,192,821 | 3/1940 | Torines | 5/81 C |
| 2,404,734 | 7/1946 | Lenahan | 5/86 |
| 2,607,050 | 8/1952 | Binschoff | 5/81 R |
| 3,099,020 | 7/1963 | Garfield et al. | 5/81 B |
| 3,403,411 | 10/1968 | Steinemann et al. | 5/81 R |
| 3,541,617 | 11/1970 | Clanan | 5/81 B |
| 3,566,422 | 3/1971 | Klippel | 5/82 R |
| 3,648,305 | 3/1972 | Ersek | 5/82 R |
| 3,684,110 | 8/1972 | Meyercord | 414/444 |
| 3,792,500 | 2/1974 | Swara, Jr. | 5/81 B |
| 3,978,531 | 9/1976 | Ilon | 5/81 R |
| 4,012,799 | 3/1977 | Rutheford | 5/81 R |
| 4,051,565 | 10/1977 | Berge | 5/81 B |

FOREIGN PATENT DOCUMENTS

| | | | |
|---|---|---|---|
| 266308 | 4/1968 | Austria . | |
| 508993 | 1/1955 | Canada . | |
| 1045308 | 2/1979 | Canada . | |
| 881024 | 7/1949 | Fed. Rep. of Germany . | |
| 836236 | 3/1952 | Fed. Rep. of Germany . | |
| 1263986 | 3/1968 | Fed. Rep. of Germany . | |
| 1274791 | 8/1968 | Fed. Rep. of Germany | 5/81 R |
| 57927 | 9/1967 | German Democratic Rep. . | |
| 118156 | 2/1970 | Norway . | |
| 527670 | 10/1940 | United Kingdom . | |
| 1038106 | 8/1966 | United Kingdom . | |
| 1151376 | 5/1969 | United Kingdom . | |
| 1177340 | 1/1970 | United Kingdom . | |
| 1349543 | 4/1974 | United Kingdom . | |
| 2023432 | 6/1979 | United Kingdom | 5/81 B |
| 197867 | 8/1967 | U.S.S.R. | 5/81 B |

*Primary Examiner*—Alexander Grosz
*Attorney, Agent, or Firm*—Daley & Brandt

[57] ABSTRACT

Devices and method for handling persons on a base, such as a bed, operating table or the like and using a pair of flat, board-shaped arms adapted for endwise manual insertion between the base and the person. Each arm is provided with a harness for securing the person thereto. An elongate connector is mounted at ends opposite those designed for manual insertion and permits displacement of the arms thereon. Lifting of the elongate connector causes pivoting of the arms about a pivotal axis at their manually inserted ends.

7 Claims, 8 Drawing Figures

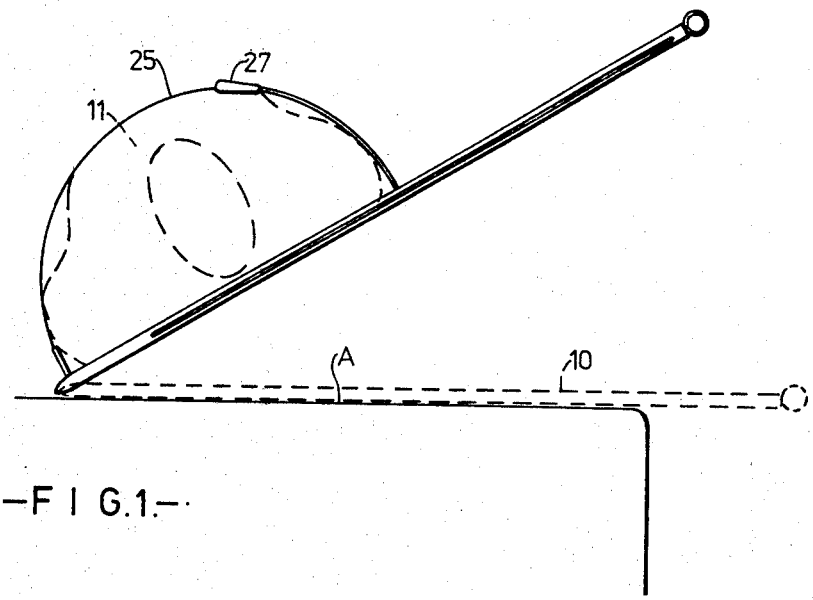
-FIG.1-
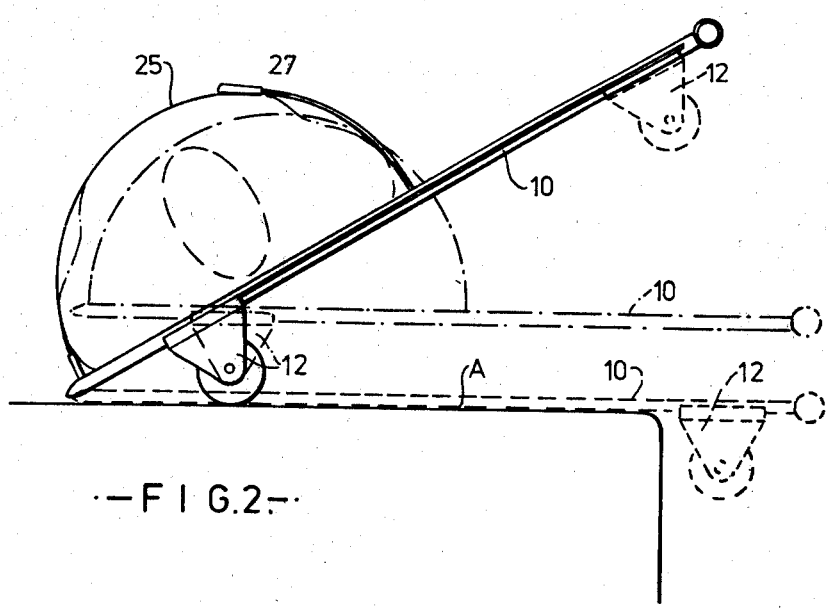
-FIG.2-

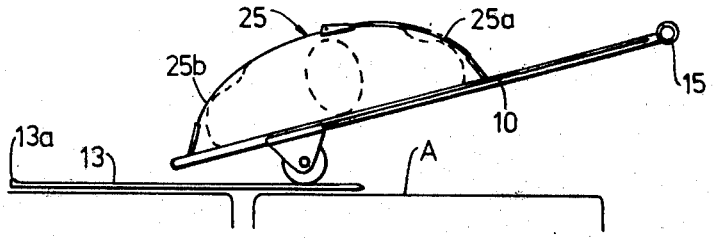
-FIG.3-
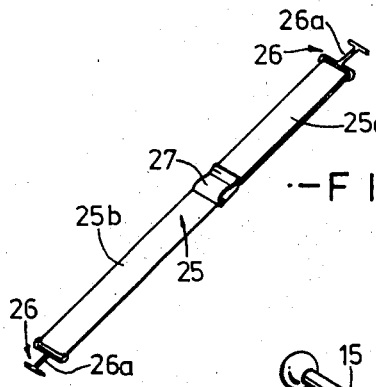
-FIG.5-
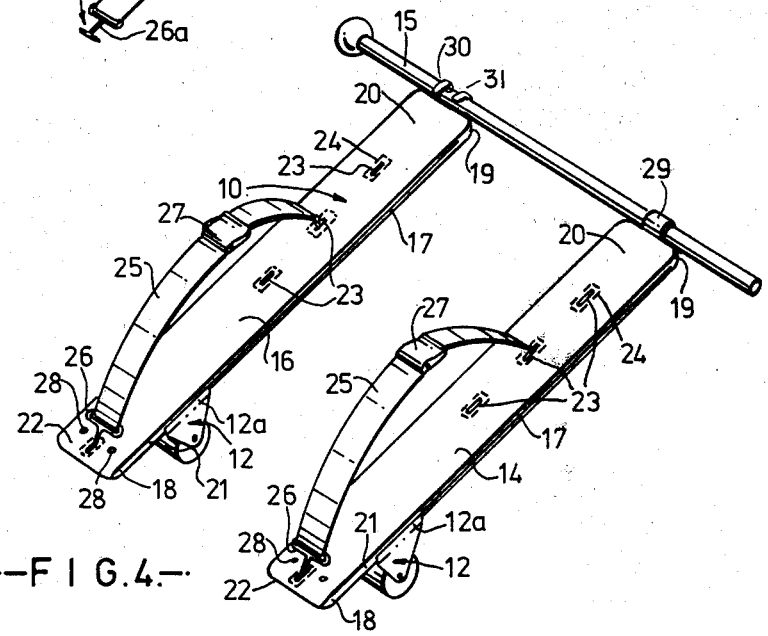
-FIG.4-

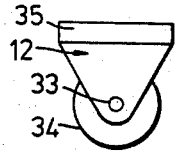
-FIG.6.-
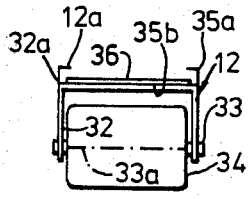
-FIG.7.-
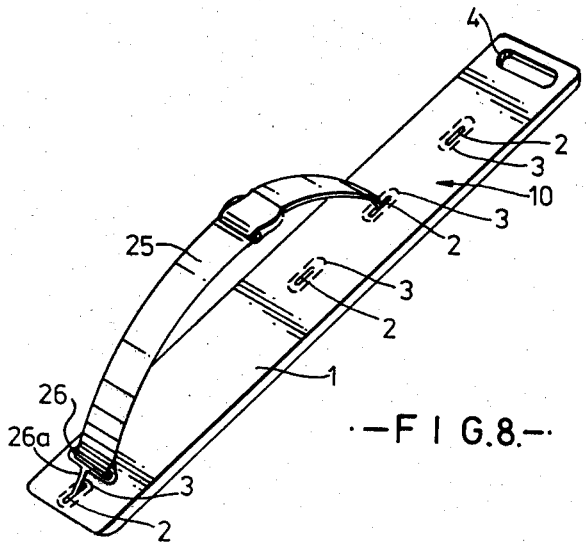
-FIG.8.-

DEVICES AND METHOD FOR HANDLING A PERSON ON A BASE

This invention relates to devices and method for handling a person on a base, such as a bed, an operating table or the like.

There is a substantial need for a device and method which can be employed for turning, rotating and locating a patient easily and gently but, at the same time, in a reliable manner on, say, a bed in hospitals, institutions such as old homes and nursing homes, as well as in the home or other arbitrary locations.

Especially as regards bed-ridden persons, e.g. newly operated, invalid and old patients, who are more or less not in condition to effect turning, rotating and locating of their own bodies into particular positions by themselves, distinct hardship and extra drudgery can often be encountered by relatives or health personnel to effect the necessary handling of the patient. Particularly complicated is the handling of relatively young patients and unconscious or extremely feeble patients. In order to be able to effect such turning or rotating of a patient, there is usually a need for extra manual assistance and it is not unusual for from 2 to 4 persons to be employed in turning or rotating a patient in a proper manner on a base.

After certain surgical operations, the patient has to be turned every other or every third hour around the clock. Old and invalid, bed-ridden patients have often a similar need to be turned in order to avoid the occurrence of bedsores. For health personnel and others who are to look after bed-ridden patients, there often occurs back inflammation as a consequence of wear and tear on the back and the like by virtue of uncomfortable working positions in combination with awkward holds during such turning and rotating operations.

An aim of the present invention is to provide a device and method for handling a patient as described above in a manner requiring little effort and, at the same time, in a way which is rapid and easy while gentle and reliable. The device and method should be simple and easily useable, should not require floor space or energy support, should be serviceable by only one person and suitable for use by relatively unskilled personnel.

According to the present invention a device for handling a person on a body-supporting base means comprises a flat, board-shaped support means adapted for endwise manual insertion between said base and said person and provided with means for fastening said person thereto.

Preferably, the device also includes an elongate connecting means mounted at an end of the support means opposite that designed for manual insertion and permitting displacement of the support means thereon, the device being such that lifting of the elongate connecting means causes pivoting of the support means about a first pivotal axis at its manually inserted end.

In use, the board-shaped support means is moved into position between the person and the base, at least at the shoulder portion and buttocks portion of the person, after which the person is secured to the support means. Thereafter, the device, with the person secured thereto, is swung about an axis at its manually inserted end while this rests directly or indirectly against the base.

This is done by applying lifting pressure at an end of the support means opposite that designed for manual insertion and in the case where an elongate connecting means is mounted at that opposite end to that connecting means itself.

This solution makes it possible for a single person under full control, with totally sure handling of the patient and a minimum exertion of force to rotate, turn and/or locate a patient in a desired position on the base.

With personal injuries and accidents in traffic and at the place of work etc., there can be problems in getting the injured or casualties arranged in position simply and safely on stretchers or other transport means for despatch to the hospital.

In one embodiment of the invention, the support means is made up of two separate arms capable of being displaced towards and away from each other on the elongate connecting means and of being pivoted simultaneously on lifting the latter about their respective manually inserted ends. Desirably, the elongate connecting means comprises a rod and fastening means for detachably interconnecting the arms and the rod after having individually arranged the arms at predetermined locations between the base and the person. The fastening means may comprise a sleeve-shaped guide means for axially displaceable reception of the rod and a pair of oppositely directed and spaced apart hook means for receiving the rod in a slopingly sideways and subsequently axially displaceable manner, the guide means and the hook means being mounted on a respective one of the non-manually insertable ends of the arms.

In another embodiment of the invention each arm has a support component mounted at its under side for slidable guided motion along its length, pivoting of the arms to an inclined position relative to the base causing simultaneous sliding of said support components by virtue of their own weight down their respective arms into supporting abutment with said base where each support component forms a second and horizontal pivotal axis for its respective arm which assumes the form of a two-branched lever whereby said arms can be pivoted via the elongate connecting means to a level above said base. Conveniently, each support component consists of a roller holder carrying a roller with an axis of rotation constituting the second pivotal axis enabling the person to be transferred on the base by means of the rollers with the arms swung upwards at a level above the base. In its unloaded condition, each support component is, desirably, freely displaceable along its respective arm while under a loading arising from the weight of the person is automatically locatable thereon in a preselected position. Each support component can be connected to its respective arm via elastically yielding brackets and a friction-promoting element can be disposed between an inner surface of the roller holder and a side of the arm adjacent thereto, said element normally permitting free passage of said roller holder along its arm while in the presence of the weight loading between said arm and said roller holder forming a contact surface between said arm and said roller holder to counteract displacement therebetween. In this way, the patient can be lifted above the level of the base which is of especial importance in connection with the transportation of an injured person or casualty who has to be moved from the base to a stretcher or other transport device.

General demands for both a device and method according to the invention is that it must be simple and the device easy to handle and operate as well as easy to keep clean or disinfect. Further, the device should be operatively reliable and non-dangerous in use. It is also necessary that it occupies little space during use as well as in the rest position and that it is easy to transport from a position of use to another. It should, therefore, be light in weight and suitably collectable in a supportable stand as a package. Preferably, the device ought to be sufficiently cheap to manufacture and maintain that it can be purchased in sufficiently large numbers at current institutions (hospitals, nursing homes, homes for the aged etc.)

In order that the invention can be more clearly understood, convenient embodiments thereof will now be described, by way of example, with reference to the accompanying drawings:

FIG. 1 is a side view of a device according to a first embodiment and illustrating, in broken lines, a board-shaped bar in a horizontal position and, in full lines, in an inclined, pivoted position.

FIG. 2 is a side view similar to that of FIG. 1, of a device according to a second embodiment and illustrating a board-shaped bar in a first horizontal position in broken lines, in a second and inclined, pivoted position in full lines and in a third and elevated horizontal position in chain lines.

FIG. 3 is a side view on a reduced scale showing the device of FIG. 2 in use for transporting a patient.

FIG. 4 is a perspective view of the device of FIG. 2.

FIG. 5 is a perspective view of a fastening belt.

FIGS. 6 and 7 are front and side views of the roller holder of the device of FIG. 2, and FIG. 8 is a perspective view of a single board-shaped bar provided with a fastening harness for the patient.

Referring to FIG. 1, there is shown device 10 in a simple construction for use for turning, rotating and locating a patient 11 to a definite position. The same device is shown in FIG. 2 with additional equipment in the form of roller holders 12 for use for lifting the patient to a level above a base A and in FIG. 3 for use in transporting the patient by means of roller holders at a level above the base A on rails 13. Each rail 13 has at one end thereof a stopping bead 13*a*.

The device 10 of FIGS. 2 and 3 is shown in further detail in FIG. 4. Device 10 is generally designed as a lever-forming lifting device in the form of a U-shaped frame member 14, 15, 16. The frame member 14–16 consists of three separate parts, namely two board-shaped bars 14 and 16 which form leg portions of the U-shape, and an intermediate, common connecting means 15 which extends across the bars at their one outer end and which forms a web portion of the U-shape.

The bars 14 and 16 can be made of wood fiber-reinforced plastic and/or a wood fiber-laminate or similar material such as light metal and can, if desired, be coated or covered with a layer for reducing the friction between the bar and the patient and additionally for sanitary reasons. The bars are conveniently made with a length of about 90 cm and a breadth of about 12 cm and a thickness of about 13 mm, and are designed flat and rectilinear but can, if desired, be designed with smaller or larger lengths, breadths and thicknesses as required and with curved or bent profiles. The bar 14 is adapted to be arranged under the shoulder portion of the patient while the bar 16 is adapted to be arranged under the buttocks portion of the patient.

The bars are provided with longitudinal slots 17 along opposite narrow sides 18. The slots 17, which extend from a stop-forming point 19 at one outer end 20 of the bar to a stop-forming point 21 at a suitable distance from the opposite outer end 22 of the bar, are adapted to form a guide for oppositely directed flange portions 12*a* of roller holders 12. With suitable intermediate spaces along the bars, there are cut out relatively short, longitudinal slots 23 which on under sides of the bars are expanded into substantially broader openings 24. In FIGS. 4 and 5, there is shown harness in the form of a fastening belt 25 designed in one piece and provided with H-shaped fastening loops 26 at opposite ends of the belt and a self-locking releasable clamping clip 27, with which the length of the belt can be regulated between the fastening loops. The fastening loops 26 of the fastening belt 25 are provided with a T-shaped head portion 26*a* which is adapted to be rotated about the axis through the web portion of the fastening loop during introduction into the slot 23 and after rotating back about the axis through the web portion of the fastening loop, the cross-piece of the T-shape is secured effectively in position in the opening 24. On shortening the length of the belt, a pull is exerted in the belt part 25*a* and on increasing the length of the belt, the clamping clip is released at the same time as there is exerted a pull in the belt part 25*b*.

In circumstances where it is not appropriate to employ fastening belts (or only one fastening belt on the one bar), there can be fastened instead of a fastening belt a loop (not shown) or similar holding device into position in throughgoing bores 28 at the outer end 22 of the bar.

Referring to FIG. 4, the two bars are provided with fastening means which differ somewhat mutually at the outer ends 20 of the bars, for fastening the bars to the common cylindrical rod 15. The cylindrical rod which can be a cylindrical pipe with plugs for closing the ends is adapted to be threaded through a sleeve-shaped fastening means 29 at the outer end 20 of the one bar 14 and through two oppositely directed, axially separate hook-shaped loop elements 30, 31 at the outer end 20 of the other bar 16. On mounting the rod 15 to the bars 14, 16, it is threaded first endways and then somewhat obliquely from above inwardly between the loop elements 30, 31 on the bar 16 and thereafter it is swung into alignment with the axis of the sleeve-shaped fastening means 29 on the bar 14 to be threaded thereafter inwardly into the sleeve-shaped fastening means 29 on the bar 14. In this way, the rod 15 can be assembled and disassembled with a minimum space requirement in a ready manner relative to the bars 14, 16. In the position which is shown in FIG. 3, the bars 14, 16 and the rod 15 are mounted together in a raised ready condition in the form of a relatively rigid frame component 14–16.

During use, the bars 14 and 16 are arranged singly in position under the patient by, for example, first pushing the bar 14 into place between the base and the patient under the shoulder portion of the patient until the outer end 22 projects suitably far outwards on the opposite side of the patient. After this, the bar 16 is pushed in a corresponding manner into place under the buttocks portion of the patient. By employing an especially smooth and fine-woven nylon cloth (not shown) on the top side of the bar, the bars can, in practice, be readily pushed into place under the patient without unpleasantness, the outer end 22 of the bars being suitably rounded so as to ease the introduction between the base and the patient. However, it has been found in practice that the bars need not necessarily be coated with such extra cloth material since a generally smooth bar surface is well-suited for the purpose.

After the bars are arranged in place under the patient at locations suitable for this purpose, the fastening belts 25 are fastened in position about the person with the fastening loops 26 of the belt fixed in place in desired slots 23 and associated openings 24 after which there is effected a suitable tightening of the belt part 25*a*. After this the rod 15 is mounted in position in elements 30 and 31 and fastening means 29 in the afore-mentioned manner and by a manual grip, if desired with only one hand, about the rod 15 the patient can be rotated, turned and located to a desired position without the exertion of particular force, but nevertheless under full control and in a reliable and gentle manner, the frame component 14–16 being used as a lever-forming lifting device. After the patient has been turned, if desired located in a desired position, the fastening belts can be released in a ready manner individually and, in turn, the rod 15 and the bars 14, 16 are released. The bar 16 can, if desired, be rotated about its longitudinal axis and thereby rotated separately out of engagement with the rod 15.

By means of the above described device 14–16 with associated fastening belts 25 (or other fastening means) plus the mentioned extra equipment (roller holders 12 and the rails 13), one can effect, as required, lifting of the patient upwards to a level above the base and, in such a raised condition, transport the patient along the base upon rails 13 or the like suitable for this purpose.

There has been illustrated one and the same equipment for such lifting and transporting of the patient but, if desired, different devices for lifting and transporting the patient can be employed.

Roller holder 12 is equipped (see FIGS. 6 and 7) with a fist inverted U-shaped loop member 32 which carries a rotary shaft 33 for a roller 34. To the top portion 32*a* of the loop member, there is fixed a U-shaped loop member 35, the vertically upwardly directed loop legs 35*a* of which are provided with oppositely directed flanges 12*a* as an extension of the loop legs 35*a*. The loop legs 35*a* and the flanges 12*a* are to receive only the weight of the roller holder 12 but are not designed to take up particular weight loads. In this connection, the loop member 35 is made of a somewhat elastically yielding material, for example, a suitably rigid plastic material, a suitably springy metal material or the like. In the bottom portion 35*b* of the loop member 35, there is fixed a furrowed or roughened up rubber plate 36 or a plate of a similar friction-promoting material or the bottom portion is itself sufficiently roughened up to produce a desired frictional effect.

While according to the first embodiment, there is used a single pivotal axis at the outer ends 22 of the bars 14, 16, in the second embodiment, there is used, in addition to the first pivotal axis, a second pivotal axis at a certain horizontal distance from the outer ends 22 of the bars. This second pivotal axis is formed (see FIG. 7) by the rotary axis 33*a* of the roller 34. As the roller holder 12 is axially displaceable on the associated bar 14 or 16, this roller axis can be easily placed centrally under the patient to provide equilibrium during swinging. Hitherto, testing has shown that this is secondary since the patient is easy to rotate even if the rollers do not stand directly below the centre line of the patient.

The roller holder 12 is normally mounted on the associated bar 14 and 16. It can be easily taken off, for example, for cleaning and replaced again by gripping it against the under side of the bar so that the flanges 12*a* snap elastically yieldingly inwards into engagement with the longitudinal slots 17 on opposite edge sides of the bar. By thereafter arranging the bars in place under the shoulder portion and buttocks portion of the patient and swinging the bars upwards from the position shown in broken lines to the position shown in full lines in FIG. 2, the roller holders 12 slide, if desired after release of a locking device, axially along the bars until they thrust against the base, for example, a mattress. The angle of the bars with the base thus decides how far the rollers get to slide downwards along the bars. By varying this angle, it is thereby easy to get the rollers positioned fairly centrally under the centre line of the patient.

When the device is now swung horizontally (see chain lines in FIG. 2) with the patient fastened for this purpose, the bars will be pressed, by the weight of the patient, against the rubber plates of the roller holders. The friction which occurs means that the roller holders are locked and the patient can be displaced horizontally.

It will be evident that the roller holders can be automatically fastened at an arbitrary location on the bars in the longitudinal direction of the bars, depending upon the sloping position of the bars with the base, there being produced contact between the bars 14, 16 under sides and the rubber discs 36 of the roller holders 12 initially after the roller holder has hit the base after the fall along the bars and after there is exerted a gripping force between the bars and the roller holders. So long as there is exerted a gripping force between the bars and the roller holders (the weight load of the patient via the bars), the roller holders are held securely in place in the intended position on the bars.

In the position illustrated in chain lines in FIG. 2, the bars 14–16 are arranged at a level above the base so that the patient can be readily raised over to the stretcher or other transport means.

In FIG. 3, there are arranged, after the bars are lifted somewhat obliquely upwards but before the roller holders have slid into place in the lower position, rails 13 in place beneath the bars 14, 16. In this case, the roller holders will fall along the bars 14, 16 on swinging the bars 14, 16 obliquely upwards into abutment against the rails 13 and on the subsequent reverse swing of the bars, the roller holders 12 with associated rollers 34 are arranged in a desired position on the bars in readiness for transportation on the rails 13. The patient can thereby be transported, via the device 14–16, the rollers 34 and the rails 13, to a desired position on the base, for example, from the centre of the bed over to one side of the bed. In addition to the relatively short rails which are designed for transporting a patient to various positions on one and the same bed location, there can be utilised longer rails for transporting the patient from one bed location to another or from the operating table to the bed location or vice-versa. These long rails are pushed under the patient from the side where the other bed location is arranged so that they reach from the patient and over to the other bed location. The bars 14 and 16 are thereafter pushed between the rail and the patient and transportation of the patient is carried out as described above. The rails can, if desired, be axially extendable, for example, telescopically extendable or jointed at the centre. If desired, the rails can form supports for the bars in the obliquely extending position of the bars on the base, the one end of the rail being able to be anchored to the underside of the bar while the opposite end forms a support against the base. The rails, the short and/or the long, can, if desired, be replaced by a plate.

In order to ensure that the rollers do not run outside the bed, the rails 13 are provided at one end with upwardly projecting stop-forming beads 13*a*.

Referring to FIG. 8, device 10 comprises a board-shaped bar 1 having relatively short longitudinal slots 2 cut out on the top side thereof and with suitable intermediate spaces therebetween. The slots 2 on the under side of the bar are expanded into substantially broader openings 3. A unitary fastening belt 25 (see FIG. 5) is provided as in the case of the previously described embodiments. In this case, the T-shaped head portion 26*a* of the loops 26 is adapted to be rotated about the axis through the web portion of the loop during introduction into the slot 2 and after rotating back about this axis, the cross-piece of the T-shape is secured effectively in position in the opening 3.

As in the case of the afore-described embodiments, device 10 of FIG. 8 is used for turning, rotating and locating patients in a preselected position. The bar has a hand grip 4.

Bar 1 can conveniently have similar dimensions to bars 14 and 16 and be made of the same type of material.

This embodiment is particularly suitable for bed-ridden patients who are, nevertheless, so physically competent that one bar can be used, for example, exclusively under the buttocks portion. Such a solution is especially appropriate for use in homes where the turning of bed-ridden patients, for example, senile persons, having mental problems or other physical problems is important.

The device 14–16 and associated extra equipment 12, 13 have been illustrated in an especially simple construction with a particularly general area of application. It is apparent that, in addition, further auxiliary equipment can be employed where desirable. For example, there can be employed an extra support arrangement for supporting the neck and head of the patient where this is found to be desirable or necessary, the support arrangement being able to be fastened readily detachable to the one bar, for example, the bar 14. There can be further employed an extra support arrangement for the legs of the patient and this support arrangement can be similarly readily detachably fastened to the other bar. If desired, the two support arrangements can , in addition, be connected mutually to each other. It will also be possible to employ an extra back supporting arrangement in certain, wholly special circumstances. The said extra support arrangements are not necessary in the most practical cases and will certainly only remain unused in a large number of instances but can, nevertheless, constitute a supplement to the simple construction or an extra security in other cases.

Instead of fastening the roller holders 12 on the bars 14, 16, the roller holders (or another suitable tilting arrangement) can be fastened to the rails with the rollers projecting upwards against the under sides of the bars. In this way, one can obtain a corresponding retilting as described above and a transportation on the base, at any rate to a certain horizontal extent.

However, it is essential to employ the fewest possible parts for the most possible working operations in connection with turning and moving of a patient and, in this connection, an attempt has been made to arrange the most possible of the relevant parts on the bars so that these are ready for use for various purposes with some receiving a simple hand grip. It must be added that a device and method according to the invention has great flexibility so that it is as equally applicable to children as for large and heavy patients. Thus, one can regulate the distance between the bars, as required, by placing the bars singly in position under the patient and thereafter securing the bars relative to each other (via the patient) by means of the readily assembled an disassembled rod 15. The fastening of the patients on the bars can be similarly regulated, as required, via the various slots 23 and by extending and shortening the length of the belt 25.

I claim:

1. A device for handling a person on a body-supporting base comprising a flat, board-shaped support means adapted for endwise manual insertion between said base and said person transversely of said person, said support means embodying structure engageable with means for fastening said person to said support means, said device further comprising elongate connecting means mounted at an end of said support means opposite that designed for manual insertion and permitting displacement of said support means thereon, the device being such that lifting of said elongate connecting means causes pivoting of said support means about a first pivotal axis at its manually inserted end, said support means being made up of two separate arms capable of being displaced towards and away from each other on said elongate connecting means and of being pivoted simultaneously on lifting the latter about their respective manually inserted ends, said elongate connecting means comprising a rod and fastening means for detachably interconnecting said arms and said rod after having individually arranged said arms at predetermined locations between said base and said person, the device being in the form of a substantially rigid and U-shaped lifting means upon such interconnection, said fastening means comprising a sleeve-shaped guide means for axially displaceable reception of said rod and a pair of oppositely directed and spaced apart hook means for receiving said rod in a slopingly sideways and subsequent axially displaceable manner, said guide means and said hook means being mounted on respective ones of the non-manually insertable ends of said arms.

2. A device for handling a person on a body-supporting base comprising a flat, board-shaped support means adapted for endwise manual insertion between said base and said person transversely of said person, said support means embodying structure engageable with means for fastening said person to said support means, said device further comprising elongate connecting means mounted at an end of said support means opposite that designed for manual insertion an permitting displacement of said support means thereon, the device being such that lifting of said elongate connecting means causes pivoting of said support means about a first pivotal axis at its manually inserted end, said support means being made up of two separate arms capable of being displaced towards and away from each other on said elongate connecting means and of being pivoted simultaneously on lifting the latter about their respective manually inserted ends, each one of said arms having a support component mounted at its under side for slidable guided motion along its length, so that pivoting of said arms to an inclined position relative to said base will cause said support components to slide by virtue of their own weight down their respective arms into supporting abutment with said base where each such support component forms a second and horizontal pivotal axis for its respective arm whereby said arms can be pivoted via said elongated connecting means to a level above said base.

3. A device according to claim 2, wherein each one of said support components includes a roller holder slidably mounted to the associated one of said arms and a roller rotatably mounted to such holder on an axis of rotation transverse to the length of such arm, so that such axis of rotation will constitute said second pivotal axis.

4. A device according to claim 3, wherein each of said roller holders is connected to its respective arm via elastically yielding brackets and a friction-promoting element is disposed between an inner surface of each such roller holder and a side of the associated arm adjacent thereto, each such element normally permitting free passage of the associated roller holder along its arm while in the presence of said weight-loading between such arm and such roller holder forming a contact surface between such arm and such roller holder to counteract displacement therebetween.

5. A device according to claim 4, wherein said friction-promoting element is secured to said roller holder and is composed of a furrowed rubber plate.

6. A device according to claim 1, wherein each such support component is freely displaceable in its unloaded condition along its respective arm while under a loading arising from the weight of said person such component is automatically locked in position relative to such arm.

7. A method of handling a person lying on a body-supporting base comprising the steps of:

(a) inserting two separate flat, board-shaped support arms between the base parallel to one another so that said support arms extend transversely of the person and the ends of such arms opposite from their inserted ends project laterally from the person and such projecting ends are disposed on the same side of the patient.

(b) fastening the person to the support means;

(c) lifting the projecting ends of said support arms to pivot the support arms about their inserted ends, thereby elevating the person above the base; and (d) placing a support component between each of said support arms and said base in the vicinity of the person after said lifting step and then depressing the projecting ends of the support arms to pivot said arms about the support components and thus elevate the initially inserted ends of the support arms away from the base, each such support component being disposed at the projecting end of the associated one of the arms prior to said lifting step and each such component sliding downwardly along the associated arm into abutment with said base after said lifting step.

* * * * *